US006740198B2

(12) United States Patent
Ahola et al.

(10) Patent No.: US 6,740,198 B2
(45) Date of Patent: May 25, 2004

(54) METHOD AND ARRANGEMENT FOR MIXING PULP COMPONENTS IN THE MANUFACTURE OF PAPER

(75) Inventors: Jussi Ahola, Tampere (FI); Elina Pohjala, Tampere (FI); Sakari Soini, Somero (FI); Veli-Matti Rajala, Tampere (FI); Kati Lindroos, Tampere (FI); Petri Nyberg, Helsinki (FI); Pentti Saarenrinne, Tampere (FI)

(73) Assignee: Metso Paper Inc., Helsinki (FI)

( * ) Notice: Subject to any disclaimer, the term of this patent is extended or adjusted under 35 U.S.C. 154(b) by 0 days.

(21) Appl. No.: 10/116,285

(22) Filed: Apr. 4, 2002

(65) Prior Publication Data

US 2002/0166645 A1 Nov. 14, 2002

Related U.S. Application Data

(63) Continuation of application No. PCT/FI00/00872, filed on Oct. 11, 2000.

(30) Foreign Application Priority Data

Oct. 12, 1999 (FI) ..... 19992195

(51) Int. Cl.[7] ..... D21F 1/06; D21F 11/00

(52) U.S. Cl. ..... 162/57; 162/55; 162/52; 162/216; 162/336

(58) Field of Search ..... 162/57, 52, 55, 162/212, 216, 186, 336; 366/336–341

(56) References Cited

U.S. PATENT DOCUMENTS

| | | | | | |
|---|---|---|---|---|---|
| 3,839,145 | A | | 10/1974 | Bueckle | |
| 4,674,888 | A | * | 6/1987 | Carlson | 366/337 |
| 5,030,326 | A | | 7/1991 | Nous | |
| 5,279,709 | A | * | 1/1994 | Niskanen | 162/52 |
| 5,316,383 | A | * | 5/1994 | Begemann et al. | 366/160.1 |
| 5,518,311 | A | * | 5/1996 | Althaus et al. | 366/181.5 |
| 5,549,792 | A | * | 8/1996 | Begemann et al. | 162/216 |
| 5,876,564 | A | * | 3/1999 | Aidun | 162/216 |
| 6,000,841 | A | * | 12/1999 | Cooke et al. | 366/337 |
| 6,153,057 | A | * | 11/2000 | Aidun | 162/343 |
| 6,406,595 | B1 | * | 6/2002 | Aidun | 162/216 |
| 2002/0110047 | A1 | * | 8/2002 | Bruck et al. | 366/340 |

FOREIGN PATENT DOCUMENTS

| | | |
|---|---|---|
| FI | 100168 | 10/1968 |
| WO | WO-99/64666 | 12/1999 |

* cited by examiner

*Primary Examiner*—Jose A. Fortuna
(74) *Attorney, Agent, or Firm*—Alston & Bird LLP

(57) ABSTRACT

The invention relates to a method of mixing pulp components in the manufacture of paper, in which method the pulp components to be mixed are led to a mixing point along tubes arranged inside each other. The pulp component flows are mixed by generating turbulence in them by means of the end of an inner tube, the cross-section of which end is wave-like. This turbulence is guided and its effect is intensified by means of form parts in connection with the mixing point, which form parts are arranged on the inner surface of the outer tube. Further, the invention relates to an arrangement implementing the mixing of pulp components in accordance with the method.

11 Claims, 4 Drawing Sheets

SECTION A - A

SECTION C - C

METHOD AND ARRANGEMENT FOR MIXING PULP COMPONENTS IN THE MANUFACTURE OF PAPER

CROSS-REFERENCE TO RELATED APPLICATIONS

This application is a Continuation of International Application PCT/FI00/00872 filed on Oct. 11, 2000, which designated the U.S. and was published under PCT Article 21(2) in English, and which is hereby incorporated herein in its entirety by reference.

BACKGROUND OF THE INVENTION

1) Field of the Invention

The invention relates to a method of mixing pulp components in the manufacture of paper, according to which method a first pulp component is fed along an outer tube to a mixing point, the other pulp components being fed along at least one inner tube arranged inside the outer tube to the mixing point, whereby flows of said pulp components combine at the mixing point.

Further, the invention relates to an arrangement for mixing pulp components in the manufacture of paper, which arrangement comprises an outer tube for leading a first pulp component to a mixing point and at least one inner tube arranged inside the outer tube, whereby the inner tube is arranged substantially in parallel with the outer tube at least by its outer end, and in which arrangement a second pulp component is arranged to be led from the inner tube to the mixing point in such a way that flows of the pulp components to be fed are arranged to combine at the mixing point.

2) Description of Related Art

There are several points in different processes of paper manufacture where different mixtures of fluid and desired pulps and other substances have to be mixed with each other. For example, fiber pulp is thickened and diluted as required by feeding fiber suspension or dilution water thereto prior to leading it to the head box of the paper machine. Required additives, such as coloring, retention and filling agents, may also be mixed into the main flow. The fluids may be mixed using different tube mixers or by means of mechanical mixers in a tank. Cones and different tube joints, such as T and Y joints, are utilized for the mixing taking place in a tube. Further, additives may be mixed into a fluid flow by feeding them as jets against the main flow in the direction of the radius. A problem with known solutions is, however, that the mixing does not take place in a satisfactory way, which causes various problems at the following stages of the process. For example, variation in the consistency of the fiber flow as a result of inferior mixing in the dilution or thickening easily leads to problems in the product quality.

BRIEF SUMMARY OF THE INVENTION

An object of the present invention is to provide a novel and improved solution for mixing pulp components in a tube.

The method according to the invention is characterized by generating at the mixing point turbulence in the flows of the pulp components to be mixed by means of an inner tube end having a wave-like cross-section, and by guiding the turbulence generated in this way by means of form parts positioned in the vicinity of the inner tube end and arranged on the inner surface of the outer tube, the greatest cross-section of the form parts being after the outermost end of the inner tube in the direction of flow.

Further, the arrangement according to the invention is characterized in that the outer end of the inner tube has a wave-like cross-section, whereby it is arranged to generate turbulence in the flows to be mixed; that in connection with the mixing point, there are form parts arranged on the inner surface of the outer tube for guiding the generated turbulence; and that the greatest cross-section of the form parts is after the outermost end of the inner tube in the direction of flow.

The essential idea of the invention is that the pulp components are fed to the mixing point of the pulp components along tubes arranged inside each other. For the purpose of mixing, the cross-section of the inner tube end is made wave-like, whereby it generates turbulence in the pulp component flows. The mixing effect of the turbulence is intensified by means of form parts arranged on the inner surface of the outer tube in connection with the mixing point, which form parts guide and intensify the generated turbulence. Still further, the essential idea of a preferred embodiment of the invention is that the cross-section of a form part changes in the direction of the radius and periphery of the outer tube in the direction of flow, whereby it changes from a linear front edge to a sector of a circle and back to a linear rear edge.

An advantage of the invention is that the pulp components to be mixed can be mixed with each other more efficiently and reliably than before, whereby the earlier problems at the following stages of the manufacturing process, resulting from the mixing, can be avoided. This naturally improves the efficiency of the process and enables manufacture of products having uniform quality. Moreover, good mixing even allows smaller amounts of additional components to be mixed into the main flow, because now inferior mixing does not have to be compensated for with oversized feed of components. Form parts according to the invention allow intensification of the turbulence generated by means of the inner tube end having a wave-like cross-section, more efficient mixing of the pulp components being consequently achieved. Further, what is known as the ejector effect can be reduced by means of form parts. As a form part is formed in such a way that its cross-section area begins from zero and ends at zero, the fibers or other component parts do not adhere to it but it remains clean easily. Combining an inner tube having a suitable wave-like form and suitable dimensions with form parts suitably dimensioned and appropriately positioned relative to the end of the inner tube allows the tailoring of a mixer giving the best possible result in each particular case.

BRIEF DESCRIPTION OF THE SEVERAL VIEWS OF THE DRAWINGS

The invention is described in more detail in the attached drawings, in which.

DETAILED DESCRIPTION OF THE INVENTION

Figure 1:
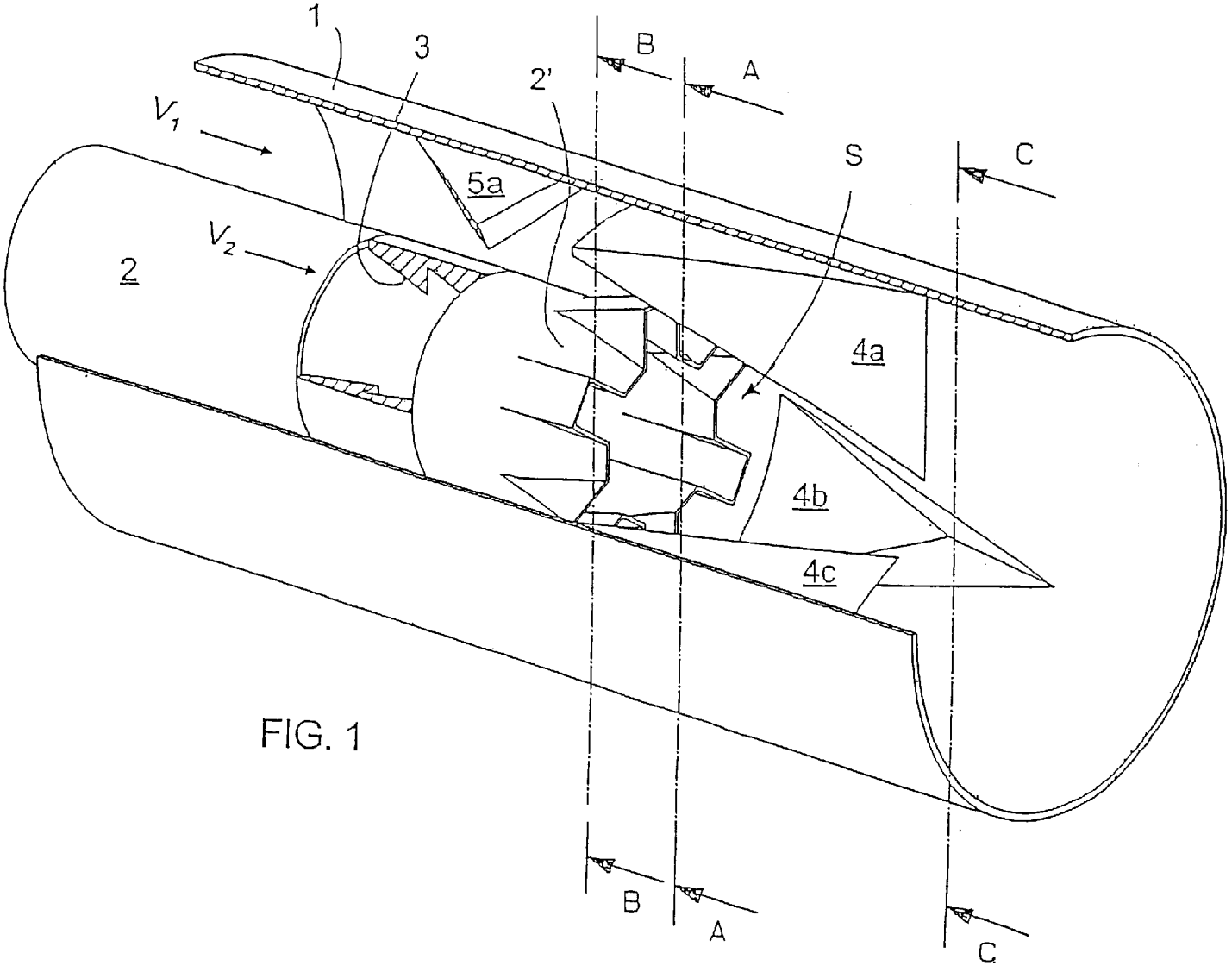
FIG. 1 is a schematic sectional perspective view of an arrangement according to the invention.
Figure 2:
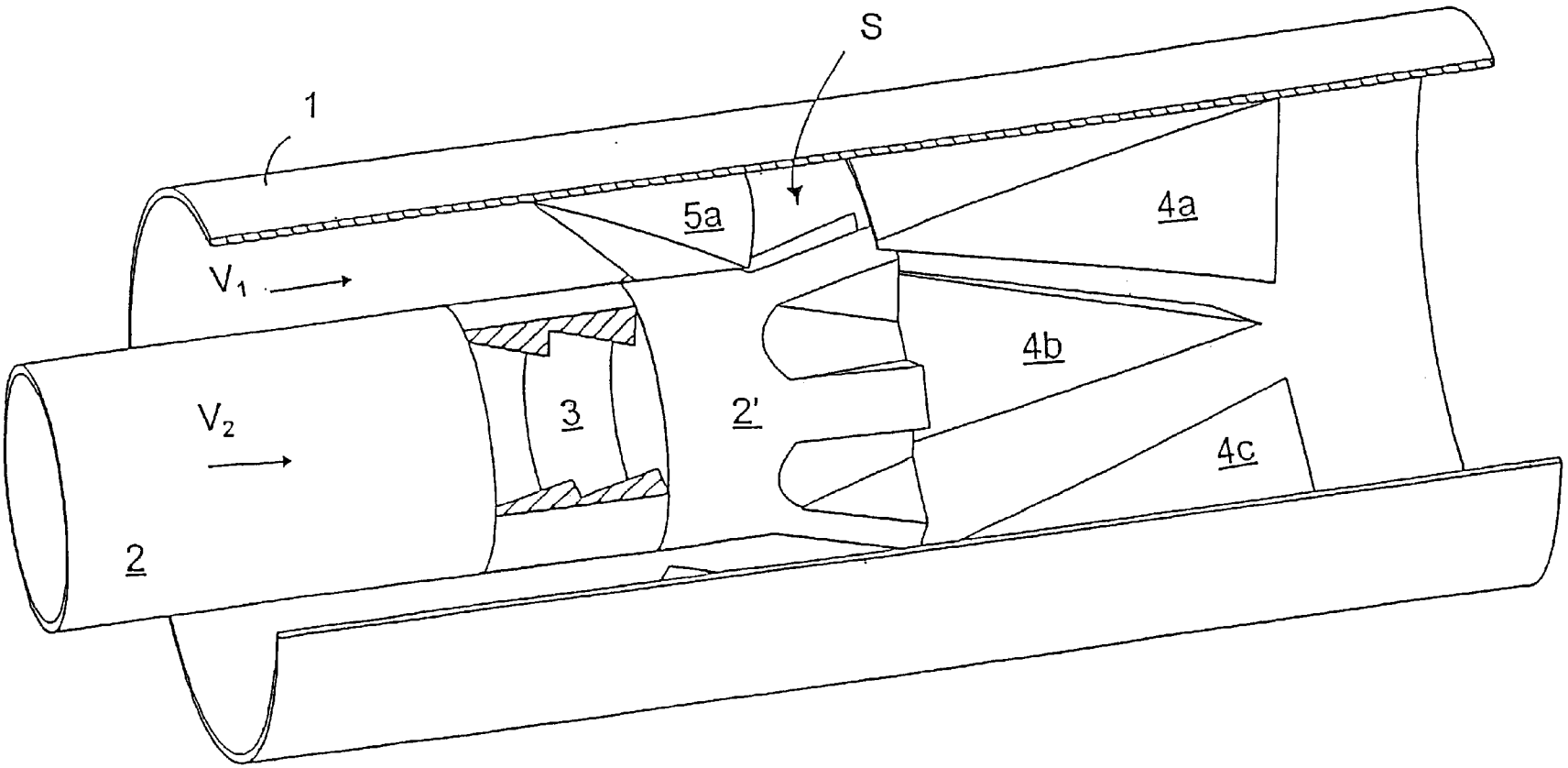
FIG. 2 illustrates, also as a perspective view, a corresponding arrangement seen from a slightly different angle.

FIG. 1 illustrates a simplified view of an arrangement according to the invention. The arrangement comprises an outer tube 1, one side of which has been sectioned in the figure to show the structure of the tube. An inner tube 2 is arranged inside the outer tube, substantially in parallel with the outer tube. Preferably, the tubes 1 and 2 are arranged coaxially. A first flow $V_1$ denoted in the figure flows in the outer tube, while a second flow $V_2$ flows in the inner tube. The pulp component flowing in the tubes is a mixture of a fluid and a suitable dry solid, such as a mixture of fiber and water, or alternatively mere fluid, such as dilution water. Generally, the main flow which consists of fiber pulp, for example, is led along an annular channel limited by the outer tube and the inner tube. Correspondingly, a side flow to be mixed into the main flow is led along the channel limited by the inner tube, which side flow consists of dilution water or some additive, for example. It is obvious that the flows may also be arranged in the opposite way. The flows $V_1$ and $V_2$ are mixed with each other at a mixing point denoted by S in the figure. The mixing is brought about by generating turbulence in the flows. For this purpose, the cross-section form of the end 2' of the inner tube is wave-like. The wave-like form refers to, for example, a sine wave, a serrated wave, a rectangular wave or other wavelike forms applicable to the purpose, by means of which the flows can be made swirl. Further, the inner tube may comprise a fluidizator 3 before the wave-like end. This kind of a fluidizator further intensifies the mixing, particularly when the consistency of the flowing substance is high (a plug flow). The fluidizator shown in the figure first comprises a converging part in the direction of flow, which part then enlarges rapidly, causing changes in the flow rate and pressure. The structure and operating principle of such a fluidizator as such are known to a person skilled in the art and are therefore not described in greater detail herein.

Figure 3A:
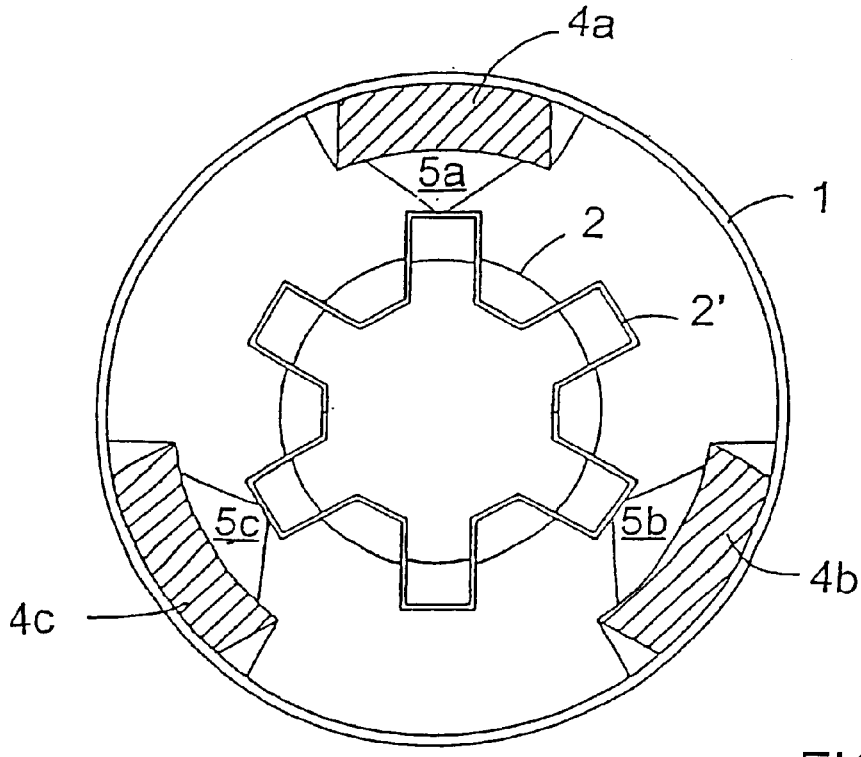
FIGS. 3*a* to 3*c* schematically illustrate cross-sections of the arrangement according to the preceding figures.
Figure 3B:
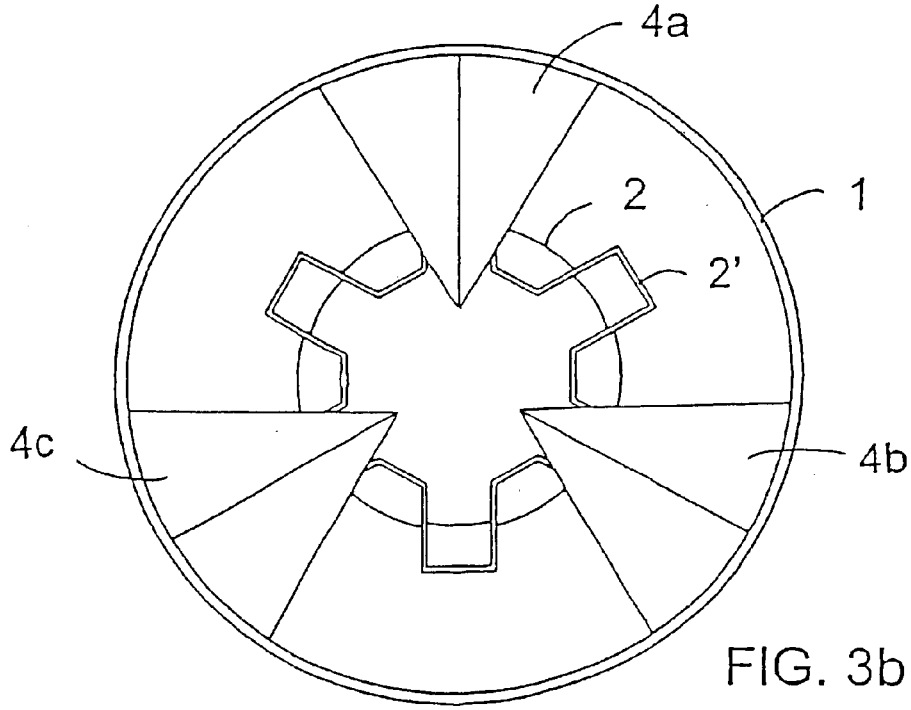

In accordance with the idea of the invention, form parts 4*a* to 4*c* are arranged in the outer tube in the part following the end of the inner tube, the purpose of which pieces is to affect the turbulence generated by means of the wave-like cross-section form of the inner tube end 2' and thus to further intensify the mixing of the pulp components. Such form parts are arranged on the inner periphery of the outer tube and their number and dimensioning are determined as required. Preferably, there are three form parts arranged at equal distances from each other on the periphery of the tube 1 and at equal distances from the inner tube in the direction of the longitudinal axis of the tubes. A preferred cross-section of the form parts can be seen in FIG. 3*a*. Seen from the direction of flow, the area of a form part is at first zero, because its front edge is a linear surface in the direction of the periphery; when proceeding in the direction of flow, the area grows in the direction of the radius into a cross-section formed as a sector of a circle. At the same time as it grows in the direction of die radius of the tube 1, proceeding in the direction of flow, the size of the form part begins to diminish in the direction of the periphery, i.e., the circumferential direction. Hence, the rear edge of the form part is linear again, as can be clearly seen in FIG. 3*b*. Such form parts can also be arranged in such a way that the sharp edge in the direction of the radius is directed forwards, i.e. in the manner exactly opposite to what is shown in the figures. In both cases, it is typical of the form part that it begins as a linear surface, its area being substantially zero, and ends again as a linear surface. Such a form part easily remains clean, because fibers and other substances in the flow do not easily adhere to it. Further, such a form part directs the flows flexibly toward each other and affects in this way the mixing of the pulp components. Although the figures show that the front edge of the form part is at the end of the inner tube, it is totally feasible to arrange the form parts and the end of the inner tube end in such a manner that they overlap part of the way, but in such a maimer that the greatest cross-section of the form parts is after the inner tube end in the direction of flow. Thus, the flows have time, to mix sufficiently as a result of the turbulence before the form parts start to guide them. Correspondingly, the form parts may be arranged at a predetermined distance from the end of the inner tube in the direction of flow.

Figure 3C:
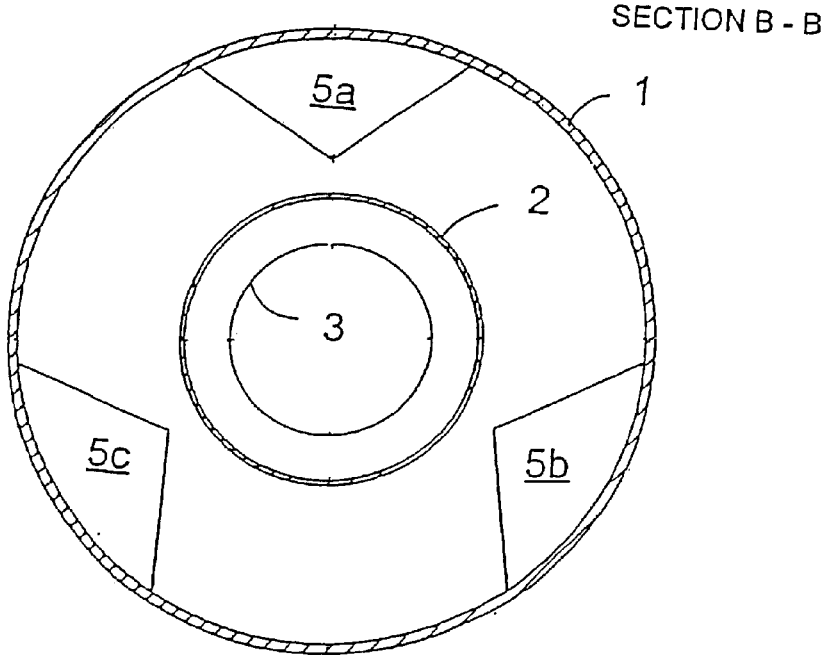

FIG. 3*c*, in particular, shows second form parts 5*a* to 5*c* arranged on the inner surface of the outer tube 1 before the end of the inner tube in the direction of flow. Such form parts also generate turbulence and intensify the mixing. These form parts may be pyramid-like, as shown in the figure, or alternatively, profiles like the form parts after the mixing point may be used.

Mixing characteristics of the arrangement according to the invention may be adjusted by changing the position of the form parts relative to the wave-like end of the inner tube, by changing the dimensions and/or the form of the form parts and by combining a suitable number of different form parts. Further, the form parts may in some cases be arranged at slightly different distances from the inner tube end in the direction of the longitudinal axis of the outer tube and at irregular distances on the periphery. The form parts may also be adjustable. This allows, for example, adjustment of the position of the form parts both relative to the tube and relative to each other. As regards their form and dimensions, the form parts may also be constructed in such a way that they can be adjusted in different ways.

Figure 4:
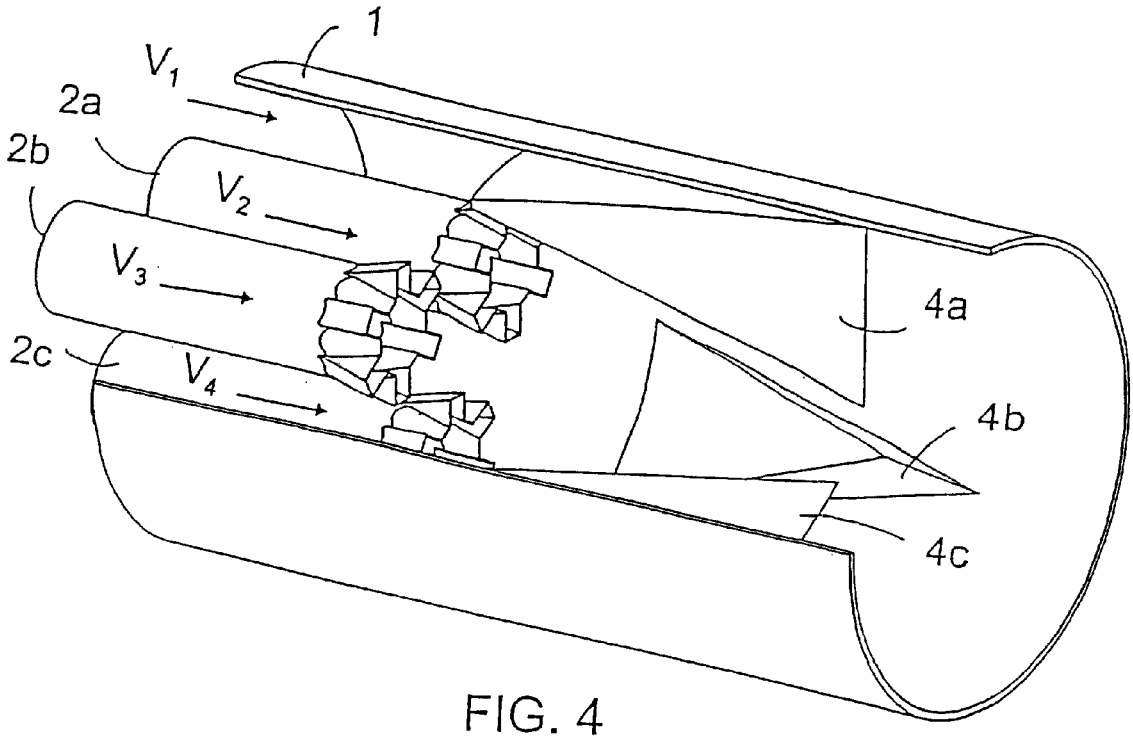
FIG. 4 is a schematic sectional view of still another application of the arrangement according to the invention.

FIG. 4 shows a solution having several, in this case three, inner tubes 2*a* to 2*c* in the direction of the outer tube. If required, there may be more inner tubes. The cross-section of each inner tube end is wave-like. Form parts growing in the direction of the radius and diminishing in the direction of the periphery are arranged in connection with the mixing point. Second form parts before the mixing point may also be used.

Further, form parts may in some cases be used for facilitating the support of inner tubes inside the outer tube.

The drawings and the related description are only intended to illustrate the idea of the invention. The details of the invention may vary within the scope of the claims.

That which is claimed:

1. A method of mixing pulp components in the manufacture of paper, comprising:

feeding a first pulp component along an outer tube to a mixing point;

feeding other pulp components along at least one inner tube arranged inside the outer tube to the mixing point;

combining flows of said pulp components at the mixing point;

generating turbulence in the flows of the pulp components at the mixing point by way of an inner tube end having a wave-like cross-section; and guiding the generated turbulence by way of separate form parts positioned in the vicinity of the inner tube end and arranged on the inner surface of the outer tube, the greatest cross-section of the form parts being after the outermost end of the inner tube in the direction of flow.

2. A method according to claim 1, further comprising fluidizing at least one of the flows of the pulp components prior to leading it to the mixing point.

3. A method according to claim 1, further comprising arranging several inner tubes inside the outer tube, whereby several separate flows are led to the mixing point.

4. An arrangement for mixing pulp components in the manufacture of paper, which arrangement comprises:

an outer tube for leading a first pulp component to a mixing point; at least one inner tube arranged inside the outer tube, wherein the inner tube is arranged substantially parallel with the outer tube at least at its outer end and a second pulp component is arranged to be led to the mixing point in such a way that flows of the pulp components to be fed are arranged to combine in the mixing point, and further wherein the outer end of the inner tube has a wave-like cross-section arranged to generate turbulence in the flows to be mixed; and, a plurality of form parts arranged on the inner surface of the outer tube for guiding the generated turbulence, the greatest cross-section of the form parts being located after the outermost end of the inner tube in the direction of flow.

5. An arrangement according to claim 4, wherein the cross-sectional area of the form parts in the direction of flow is at first zero, growing then in the direction of the radius or periphery of the outer tube until it diminishes again to zero in the direction of the radius or periphery, whereby the front and rear edges of the form part are linear and in the part between them the area of the form part has the form of a sector of a circle.

6. An arrangement according to claim 5, wherein the front edge of the form part is a linear surface in the direction of the periphery of the outer tube, and the rear edge of the form part is, in turn, a linear surface in the direction of the radius of the outer tube.

7. An arrangement according to claim 5, wherein the front edge of the form part is a linear surface in the direction of the radius of the outer tube, and the rear edge of the form part is, in turn, a linear surface in the direction of the periphery of the outer tube.

8. An arrangement according to claim 4, wherein the arrangement comprises second form parts on the inner surface of the outer tube before the mixing point.

9. An arrangement according to claim 4, wherein the inner tube comprises a fluidizator before the wave-like end.

10. An arrangement according to claim 4, wherein the position of the form parts is adjustable.

11. An arrangement according to claim 4, wherein the form of the form parts is adjustable.

* * * * *